US009429048B2

(12) United States Patent
Dupke et al.

(10) Patent No.: US 9,429,048 B2
(45) Date of Patent: Aug. 30, 2016

(54) SUPPORT ELEMENT FOR A VALVE TRAIN OF AN INTERNAL COMBUSTION ENGINE, AND METHOD FOR PRODUCTION OF SUPPORT ELEMENT

(71) Applicant: Schaeffler Technologies AG & Co. KG, Herzogenaurach (DE)

(72) Inventors: Stefan Dupke, Kodnitz (DE); Horst Gredy, Oberreichenbach (DE); Jochen Blasch, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/703,052

(22) Filed: May 4, 2015

(65) Prior Publication Data

US 2015/0322823 A1 Nov. 12, 2015

(30) Foreign Application Priority Data

May 9, 2014 (DE) ..... 10 2014 208 811

(51) Int. Cl.
*F01L 1/24* (2006.01)
*F01L 1/18* (2006.01)

(52) U.S. Cl.
CPC .. *F01L 1/18* (2013.01); *F01L 1/24* (2013.01); *F01L 2001/2433* (2013.01); *F01L 2103/00* (2013.01); *F01L 2109/00* (2013.01); *Y10T 29/493* (2015.01)

(58) Field of Classification Search
CPC ..... F01L 1/2405; F01L 2001/2433; F01L 2103/00; F01L 2109/00
USPC ..... 123/90.15, 90.46, 90.56
See application file for complete search history.

(56) References Cited

U.S. PATENT DOCUMENTS

2003/0172889 A1* 9/2003 Djordjevic ..... F01L 1/08 123/90.16
2010/0071649 A1* 3/2010 Janowiak ..... F01L 1/2405 123/90.55
2011/0061615 A1* 3/2011 Hendriksma ..... F01L 1/24 123/90.15
2012/0042843 A1* 2/2012 Kubota ..... F01L 1/185 123/90.55

FOREIGN PATENT DOCUMENTS

DE 10330510 1/2005

* cited by examiner

*Primary Examiner* — Jorge Leon, Jr.
(74) *Attorney, Agent, or Firm* — Volpe and Koenig, P.C.

(57) ABSTRACT

A support element for the valve train of an internal combustion engine, having a hollow cylindrical housing that holds a displaceable piston. The piston has a hollow cylindrical pressure part and a pot-shaped work part axially adjacent thereto. An inner space of these parts forms a storage space for hydraulic medium. A high pressure space is defined by a base of the work part and the housing. The storage space and the high pressure space are connected hydraulically by a non-return valve with a ball for automatic lash compensation of the valve train. The piston is supported by a compression spring on the housing base, and a retaining ring is arranged radially between the pressure part and the housing, which limits axial travel of the piston. The ball is movably held in the base of the work part in an axial ball guide having first and second integrally formed ball seats.

10 Claims, 3 Drawing Sheets

SUPPORT ELEMENT FOR A VALVE TRAIN OF AN INTERNAL COMBUSTION ENGINE, AND METHOD FOR PRODUCTION OF SUPPORT ELEMENT

INCORPORATION BY REFERENCE

The following documents are incorporated herein by reference as if fully set forth: German Patent Application No. 102014208811.9, filed May 9, 2014.

BACKGROUND

The invention relates to a hydraulic support element for, among other things, the lash compensation of a valve train of an internal combustion engine.

From DE 103 30 510 A1, a support element for a switchable cam follower of a valve train of an internal combustion engine is known that has, in a housing, two separate flow paths for a hydraulic medium. The first flow path is used for supplying a hydraulic lash compensation device, while the second flow path is used to supply the hydraulic medium to coupling agents in a supported, switchable cam follower. A non-return valve with the hydraulic lash compensation device is formed with a ball that closes a hole in a base of a work piston in the closed position of the non-return valve. A valve spring presses the ball axially with a defined mechanical biasing force against the open end of the hole in the piston base, wherein the valve spring is supported between the ball and a pot-shaped cap. A radially outward directed flange of the cap contacts a bottom side axial recess of the work piston with a defined force, wherein a compression spring for generating the necessary contact pressure force is supported between the flange of the cap and a base surface of a cylindrical space of the housing of the support element. Although this support element has many advantages, it is nevertheless considered disadvantageous that the non-return valve requires, in addition to the ball and the bottom side hole in the base of the work piston, also two additional components in the form of the valve spring and the pot-shaped cap.

SUMMARY

The invention is therefore based on the objective of providing a universally usable support element without caps and valve springs for the lash compensation of a valve train of an internal combustion engine, which also has a prolonged service life with simultaneously reduced manufacturing costs. In addition, the invention is also based on the objective of providing a method for producing such a support element.

The invention is based on the knowledge that the failure rate, the installation costs, and also the testing costs, especially for tightly toleranced, complex assemblies, can be generally reduced by decreasing the number of individual parts.

The invention therefore relates to a hydraulic support element for, among other things, the lash compensation of a valve train of an internal combustion engine, with a hollow cylindrical housing that can be installed with its outer lateral surface in a receptacle hole of a cylinder head of the internal combustion engine and that holds, in its radial inward axial hole, a piston that can be displaced coaxial to a longitudinal center axis, wherein the piston is comprised of an essentially hollow cylindrical pressure part and a pot-shaped work part connecting to this pressure part, wherein at least one axially end-side head of the pressure part projects past a housing edge and is used as a support for a cam follower, wherein an inner space of the pressure part and also an inner space of the work part form a storage space for a hydraulic medium, wherein a high-pressure space for the hydraulic medium is defined by a base of the pot-shaped work part and also by the hole of the housing, wherein the storage space and also the high-pressure space are connected to each other hydraulically by a non-return valve with a ball for guaranteeing automatic lash compensation of the valve train, wherein the piston is supported with the base of the pot-shaped work part by a compression spring on a housing base, and a retaining ring that limits an axial travel of the piston is arranged between the pressure part of the piston and the housing.

To meet the stated objectives, for this support element it is provided that the ball is held in the base of the work part in an axially oriented ball guide so that it can be displaced axially and so that the ball guide has a first ball seat on the storage space side and a second ball seat on the high pressure space side, and that the two ball seats are formed integrally with the base of the work part of the piston.

Through this construction of the support element, a valve spring and a retaining cap that must otherwise be provided for the valve spring and the ball can be eliminated without replacement, which significantly decreases the number of parts and along with this, decreases the manufacturing costs and the failure rate of the support element. In particular, the comparatively expensive use of sophisticated valve springs necessary in conventional constructions can be eliminated, which also leads to a considerable reduction in the testing costs within the scope of quality assurance. The ball guidance is preferably constructed as a cylindrical hole.

According to one advantageous refinement of this support element it is provided that the first ball seat closes completely hydraulically for a ball contacting this ball seat. In this way, the high pressure space is closed hermetically tightly relative to the storage space when the ball is in contact, so that the practically incompressible hydraulic medium ideally completely filling the high pressure space acts like a rigid or mechanically fixed connection in the longitudinal direction for an axially downward motion of the piston in the direction of the housing base.

According to another advantageous refinement of this support element it is provided that the second ball seat remains at least partially open for a ball contacting this ball seat. In this way it is guaranteed that the hydraulic medium can flow into the high pressure space from the storage space while overcoming a relatively low flow resistance and the piston can travel out of the housing of the support element at least up to a height limited by the travel limit and/or the cam follower or a rocker arm.

In another construction it can be provided that the second ball seat has at least one radially inward directed projection or is formed by this projection or projections. This arrangement prevents the ball from falling out of the ball guide in the work part of the piston. The projection or projections can have, for example, the shape of a sinusoidal half wave or a semicircle. Between the projection and the hole edge and/or each of the projections, a flow space for the hydraulic medium is formed. Advantageously, three projections are constructed to form the second ball seat.

In addition, for this support element it can be provided that the axial material thickness of the base of the work part of the piston is equal to or greater than the diameter of the ball of the non-return valve. This guarantees a reliable seat for the ball within the ball guide. In addition, an integral formation of the ball seats on the base of the work part of the piston can be produced without problems in terms of production through suitable shaping processes.

The objective with respect to the method is met by a method with the following steps:

a) Production of a pot-shaped work part of a piston of the hydraulic support element, which has, in its base, an axially oriented ball guide that has a cylindrical section and an end-side narrowing section adjacent to this cylindrical section, wherein the narrowing section has a smaller diameter than a ball to be inserted into the ball guide and forms a first ball seat on the storage space side, b) Insertion of the ball into the ball guide of the work part of the piston, c) Shaping of the base of the work part of the piston on its bottom side on the high pressure space side in the area of the ball guide for forming at least one radially inward pointing projection for forming a second ball seat on the high pressure space side, wherein the ball is held captively in the ball guide in interaction with the storage space side first ball seat but can move in the axial direction, and d) Axial insertion of the piston into a housing of the support element.

This arrangement provides a production of the support element that is more economical in terms of production, because, in contrast to the previously known solutions, all of the production steps are not performed in isolation only on the work part of the piston, but instead can be completed on the entire ball-piston work part assembly beginning with the usually obligatory heat treatment. The method allows the creation of a work part that has only two parts by means of a cap-less and valve spring-less design of the support element.

According to one advantageous refinement of the method it is provided that the shaping in method step c) is formed by impact extrusion of the work part of the piston that is not hardened at least in some area or of the work part of the piston that is completely not hardened. Due to the work part of the piston that is not completely hardened in all areas, the shaping process of the work part is made considerably easier, wherein, however, under some circumstances, a final heat treatment is required for hardening the work part and/or the ball. In this configuration, the shaping takes place in the area of the second, high pressure space side ball seat of the work piston for forming the radial projections, so that the work piston is not completely hardened at least in this zone. A projection of the hollow cylindrical ball guide forming the first, storage space side ball seat can be formed, under some circumstances, simultaneously, in advance, or afterwards, for example, by a shaping process, wherein the work part of the piston is at least not completely hardened in this area.

According to another embodiment of the method, the shaping can be performed in the method step b) by orbital forming or by radial point forming of the work part of the piston hardened at least in some areas. In this way, the necessary shaping can be completed on the already hardened work part of the piston, so that usual additional treatment steps for hardening can be eliminated, but the shaping process has a more complicated form.

Corresponding to another embodiment of the method it can be provided that, before the method step a) or after the method step d), at least the ball, the work part, and/or a pressure part of the piston are subjected to a heat treatment for their hardening at least in some areas.

This arrangement enables a flexible configuration of the sequence for the method according to the invention.

For the complete assembly of the support element it can be provided that at least one compression spring acting on the work part of the piston, the shaped work part of the piston with the ball held therein, the pressure part of the piston, and also a retaining ring are inserted into a hole of the housing of the support element and secured axially by means of the retaining ring. In this way, only relatively large and easy to handle components or one assembly in the form of the work part and ball must be integrated for completing the support element.

BRIEF DESCRIPTION OF THE DRAWINGS

For further explanation of the invention, a drawing accompanies the description. Shown in the drawings are.

DETAILED DESCRIPTION OF THE PREFERRED EMBODIMENTS

Figure 1:
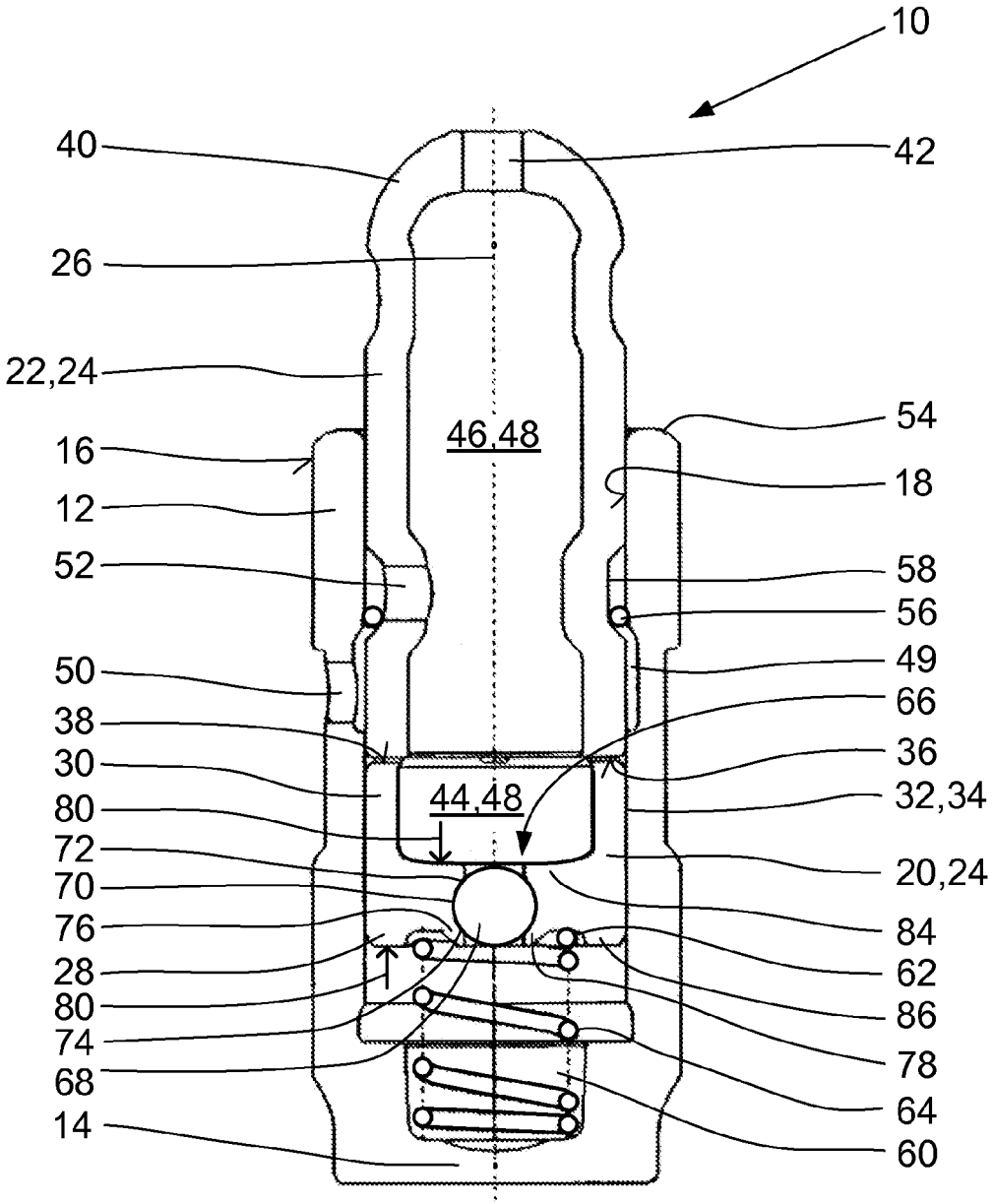
FIG. 1 a longitudinal section through a support element formed according to the invention, FIG. 2 a top view on the high pressure space side of the work part of the piston of the support element with radially inward pointing projections, and FIG. 3 to FIG. 5 schematic representations of the sequence for producing a high pressure space side ball seat on the work part of the piston.

The support element 10 according to FIG. 1 has an essentially pot-shaped housing 12 with a housing base 14. The support element 10 can be inserted with the outer lateral surface 16 of the housing 12 in a mount of a not-shown cylinder head of an internal combustion engine. In a cylindrical hole 18 of the housing 12, a piston 24 composed axially from a pot-shaped work part 20 and an essentially cylindrical pressure part 22 is held so that it can be displaced along a longitudinal center axis 26.

The work part 20 of the piston 24 has an essentially flat base 28 and a hollow cylindrical wall 30, whose outer lateral surface 32 contacts an inner surface 34 of the cylindrical hole 18 in an essentially pressure-tight manner. An end face 38 of the wall 30 of the work part 20 contacts an end face 36 of the pressure part 22. The end of the pressure part 22 pointing away from the end face 36 of the pressure part 22 is formed as a dome-shaped head 40 that is used as a support for a not-shown switchable cam follower of a valve train of the internal combustion engine. The supply of the cam follower with a hydraulic medium takes place via a coaxial cylindrical hole 42 formed centrally to the longitudinal center axis 26 of the support element 10 in the head 40.

The work part 20 that is open in the area of its end face 38 and the pressure part 22 of the piston 24 that is similarly open in the area of its end face 36 each forms approximately cylindrical inner spaces 44, 46 that together define a storage space 48 for the hydraulic medium. The hydraulic medium is preferably a lubricating oil that is otherwise necessary for lubricating the internal combustion engine and can be diverted with low expense from lubricating oil galleries or lubricating oil holes of a cylinder head of the internal combustion engine.

The feeding of the hydraulic medium into the storage space 48 is performed via a radial hole 50 in the housing 12 of the support element 10 and an opening 52 in the pressure part 22 of the piston 24. For this purpose, the radial hole 50 is in hydraulic connection with not-shown lubricating oil holes in the cylinder head of the internal combustion engine, so that, the normal lubricating oil pressure of the internal combustion engine is established in the storage space 48. To make the circulation of the hydraulic medium easier, an annular gap 49 is provided between the pressure part 22 of the piston 20 and the housing 12 of the support element 10.

At least the dome-shaped head 40 projects, in each operating state of the support element 10, past a housing edge 54 of the housing 12, wherein a retaining ring 56 in the area of an annular groove 58 of the pressure part 22 of the piston 24 and/or the cam follower contacting the dome-shaped head 40 with a positive-fit connection form an axial travel limit for the piston 24.

The base 28 of the pot-shaped work part 20 of the piston 24 defines, together with the housing base 14 and the axial hole 18 of the housing 12, a high pressure space 60 for the hydraulic medium, in which this space is at a significantly higher pressure than in the storage space 48. Between a high pressure space side annular groove 62 in the base 28 of the work part 20 and the housing base 14 there is a compression spring 64 that is arranged coaxially and by which the piston 24 is biased in a mechanically spring-like way relative to the cam follower and/or the retaining ring 56.

The high pressure space 60 is separated hydraulically from the storage space 48 by means of a non-return valve 66, so that the previously explained structural configuration of the support element 10 corresponds, in this respect, to the known embodiments of so-called "hydraulic tappets" for the lash compensation of valve trains in internal combustion engines and a detailed explanation of the lash compensation function of the support element 10 along the longitudinal center axis 26 can be eliminated at this point.

The valve spring-less and cap-less non-return valve 66 has a ball 68 that is held along the longitudinal center axis 26 in a hollow cylindrical ball guide 70 between a first ball seat 72 on the storage space side or facing the storage space 48 and a second ball seat 74 on the high pressure space side or facing the high pressure space 60 so that it can be displaced in the axial direction.

For the ball 68 contacting the first ball seat 72, the non-return valve 66 is closed hermetically tight, so that the incompressible hydraulic medium enclosed in the high pressure space 60 acts like a mechanically rigid connection relative to any downward motion of the piston 24 in the direction of the housing base 14. In contrast, in the event of an opposite, upward motion of the piston 24, the ball 68 is lifted from the first ball seat 72 by the hydraulic medium flowing into the high pressure space 60 and pressed against the second ball seat 74. The second ball seat 74 remains at least partially open also when the ball 68 is in contact and thus allows a passage of the hydraulic medium, so that the upward motion of the piston 24 acts against only a relatively low flow resistance and pumps up, so to speak, the support element 10. Here, the piston 24 of the support element 10 is pushed out slightly from the housing 12 along the longitudinal center axis 26, wherein the desired dynamic lash compensation takes place with respect to the cam follower of the internal combustion engine contacting the head 40.

To prevent the ball 68 from falling out of the non-return valve 66 or from the base 28 of the work part 20 of the piston 24, the second ball seat 74 has four small, radially inward directed projections 76, 78, 90, 92, of which only two projections 76, 78 are visible in FIG. 1. According to the invention, the two ball seats 72, 74 are formed integrally with or on the base 28 of the work part 20 of the piston 24, so that the non-return valve 66 requires, for its proper function, neither a valve spring nor a cap for securing the position of the ball 68.

To enable the integral formation of the non-return valve 66 in the course of a simple shaping process of the work part 20 of the piston 24, the axial material thickness 80 of the base 28 of the work part 20 is slightly smaller, equal to, or greater than a diameter 82 of the ball 68. The diameter 82 of the ball 68 is approximately smaller than the diameter 102 of the ball guide 70 shown in FIG. 4 in the base 28 of the work part 20. The first ball seat 72 is formed in the area of the storage space side top side 84 and the second ball seat 74 is formed in the area of the high pressure space side bottom side 86 of the base 28 integrally on the work part 20 of the piston 24. The top side 84 of the base 28 is directed toward the storage space 48 and the bottom side 86 is directed toward the high pressure space 60. A so-called axial ball travel 108 that cannot be seen in FIG. 1 is defined by the maximum axial path along the longitudinal center axis 26 that the ball 68 can travel between the two ball seats 72, 74, that is, until it contacts one of the ball seats 72, 74. This ball travel 108 that can be seen in FIG. 5 is, at most, a few tenths of a millimeter.

The valve spring-less and retaining cap-less non-return valve 66 of the support element 10 leads, in comparison to known support elements, to increased advance travel losses in the valve train of the internal combustion engine due to the structure, that is, to a slight axial sinking of the hydraulic support element 10, when a force acts in the axial direction from above on the head 40 of the pressure part 22, as is the case in the valve train, for example, immediately at the beginning of the cam follower travel. This increased advance travel loss can be explained in that the non-return valve 66 closes only when the hydraulic medium out of the high pressure space 60 begins to flow into the storage space 48 and here more and more takes along the ball 68 of the non-return valve 66. This advance travel loss therefore must be taken into account by a corresponding opening curve of the ball travel in the non-return valve 66. For this purpose, in known valve trains, a smallest possible and precisely reproducible ball travel should be given. In contrast, in variable valve trains that use, for example, a sliding cam system with corresponding radial tolerances of the camshaft, a larger ball travel can be advantageous in order to better compensate for the reference circle impact of the camshaft.

Additionally or alternatively, the ball travel can also be influenced by a variation of the surface geometry of the two ball seats 72, 74. This consequently enables a universal use of the support element 10 in a plurality of different types of valve trains of internal combustion engines.

Figure 2:
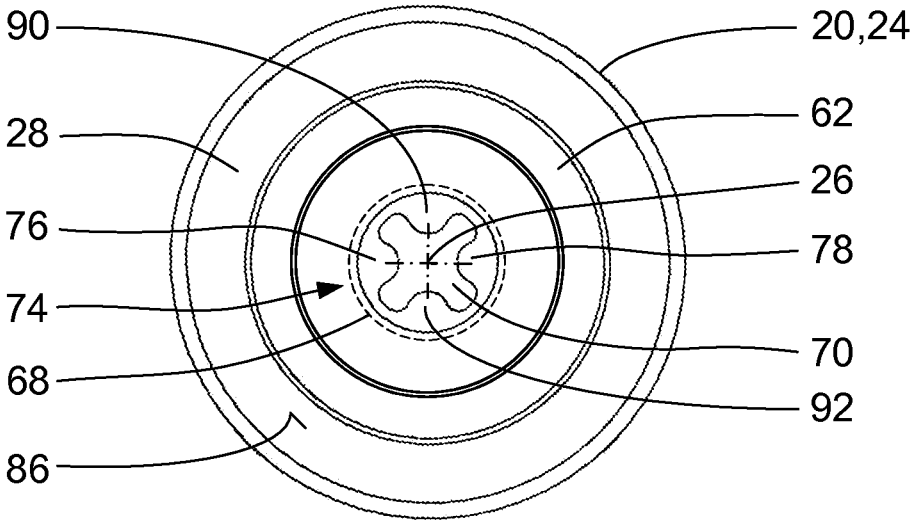

FIG. 2 shows a top view of the high pressure space side bottom side 86 of the work part 20 of the piston 24 with the already mentioned radial projections. In the bottom side 86 of the base 28 of the work part 20 of the piston 24, the annular groove 62 is formed for securing the radial position of the compression spring not shown here. The high pressure space side, second ball seat 74 has the four radially inward pointing projections 76, 78, 90, 92 for the axial securing of the position of the ball 68 in connection with the first, here covered ball seat 72. The projections 76, 78, 90, 92 are each formed integrally on the work part 20 of the piston 24 and spaced equally from each other and grouped circumferentially around the second ball seat 74 or around the ball guide 70 constructed as a hole.

Deviating from the four projections 76, 78, 90, 92 that are shown here only as an example and are positioned offset by 90° relative to each other around the longitudinal center axis 26, three or more than four projections could also be formed in the area of the second ball seat 74. The projections 76, 78, 90, 92 preferably have the shape of a sinusoidal half wave or a semicircle, but could also be formed with a different geometry. The projections 76, 78, 90, 92 prevent the ball 68 from falling out of the cylindrical ball guide 70. In addition, the four projections 76, 78, 90, 92 guarantee a defined flow of hydraulic medium when the ball 68 contacts these projections.

Figure 3:
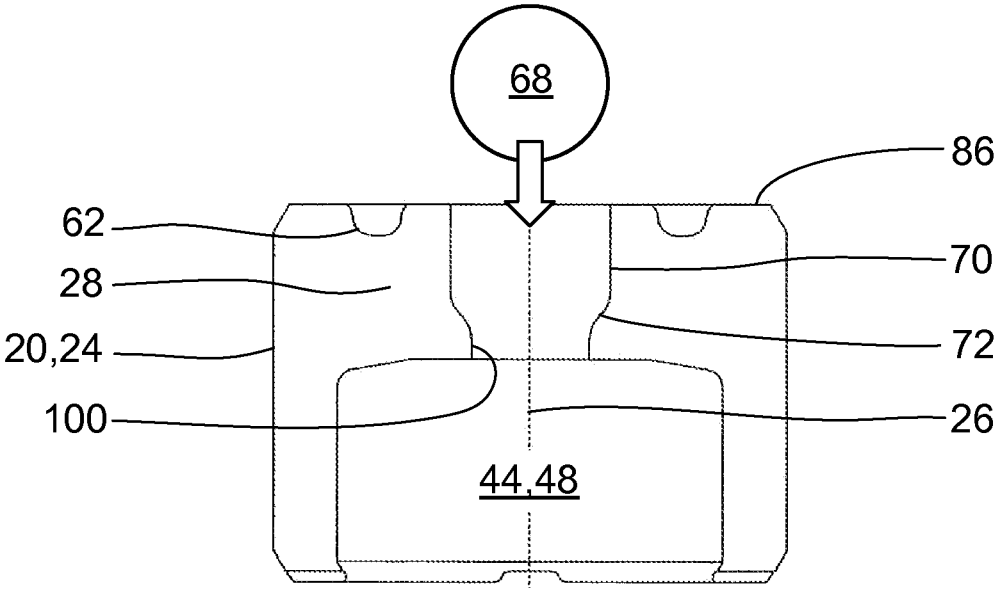
Figure 4:
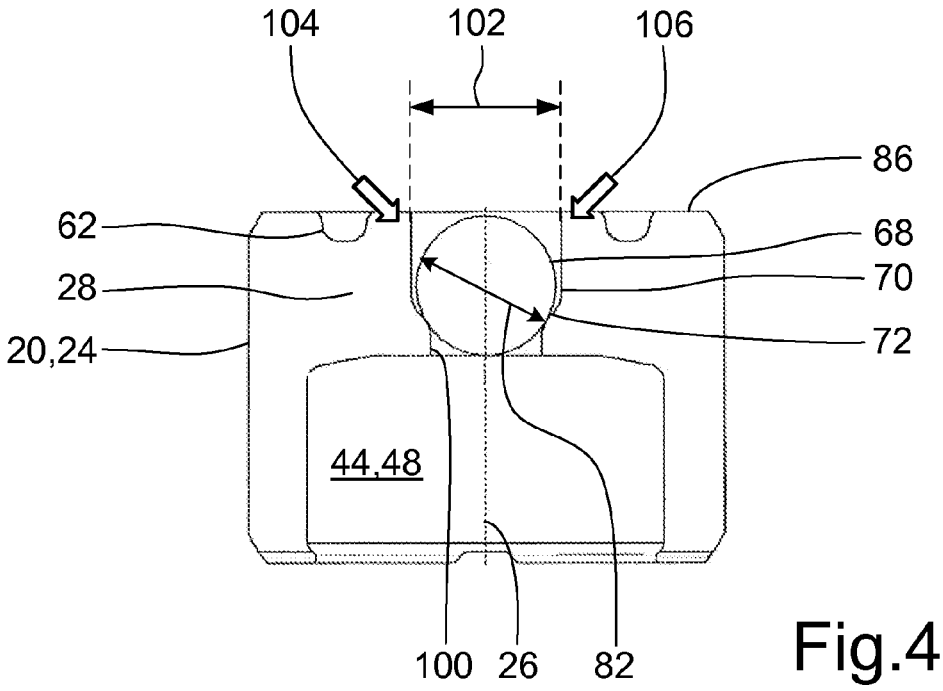
Figure 5:
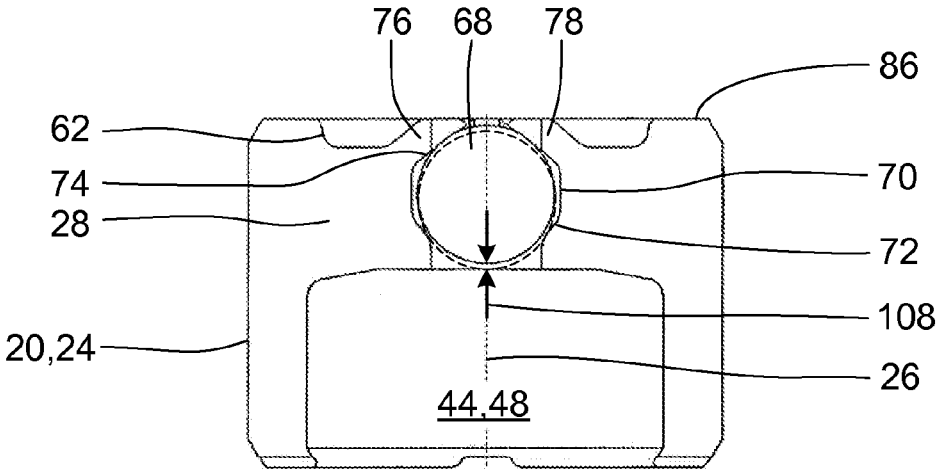

FIGS. 3 to 5, which will be referenced together in the description below, each show a schematic representation of the sequence of the production method according to the invention. The work part 20 of the piston 24 has the annular groove 62, a section-wise spherical radial narrowing section 100 forming the first ball seat 72 in the cylindrical ball guide 70 and the cylindrical inner space 44 as one part of the whole storage space 48.

As FIG. 3 shows, in a first method step first the ball 68 is inserted along the longitudinal center axis 26 into the ball guide 70 of the preassembled work part 20 of the piston 24, wherein the first ball seat 72 prevents the ball 68 from falling out due to the radial narrowing section 100, or is used as a stop for the ball 68. The first ball seat 72 is preferably formed integrally with the work part previously in the course of a production method, for example, impact extrusion or die-casting, that is suitable for producing the work part 20.

In the position shown in FIG. 4, the ball 68 is inserted completely into the ball guide 70, so that the shaping process for producing at least the high pressure space side, second ball seat 74 can begin. The diameter 82 of the ball 68 is advantageously slightly smaller than a diameter 102 of the cylindrical ball guide 70, which produces a radial play and a slightly axial displacement of the ball 68 between the ball seats 72, 74.

In a subsequent method step, starting from FIG. 4, the shaping of the work part 20 of the piston 24 takes place in the area of the bottom side 86 of the base 28 of the work part 20, until the radial projections, of which only two projections 76, 78 are visible in FIG. 5, are completely shaped and the ball 68 is secured in its axial position between the two ball seats 72, 74. The shaping is performed here as a function of the local hardness degree of the work part 20 of the piston 24, for example, in the direction of the two arrows 104, 106, for example, by impact extrusion shaping, orbital forming, radial point forming, or other suitable shaping methods.

As FIG. 5 shows, the shaping process of the work part 20 of the piston 24 is then completed and the second ball seat 74 with its projections, here only the radial projections 76, 78 are visible, is completely shaped, wherein, under some circumstances, at least the shaped areas, in particular, the radial projections and/or the ball 68, must be subjected to a final hardening process. In FIG. 5, the maximum axial ball travel 108 of the ball 68 can also be seen, namely the distance between the second position of the ball 68 shown in FIG. 5 with a solid line, in which this contacts the second ball seat 74, and the first position of the ball 68 symbolized with a dashed line in which this formed a tightly sealing contact on the first ball seat 72.

In a final method step not shown in the figures, the final installation of the support element shown in FIG. 1 is performed. This can happen, for example, by inserting the compression spring 64, the shaped work part 20 with the ball 68 held therein of the pressure part 22 of the piston 24, and also the retaining ring 56 for securing the position of the entire arrangement in the hole 18 of the housing 12 of the support element 10.

A deviation from the sequence of method steps listed here only as an example for the final installation of the support element can be advantageous for further optimizing the production process, if necessary.

By eliminating the valve spring and the retaining cap needed for securing the position of the ball and valve spring typical in known constructions, the production costs of the support element can be considerably reduced. Furthermore, an incorrect installation of the sophisticated valve spring is eliminated because this part is not used, which also eliminates the high testing costs that are otherwise needed for ensuring problem-free installation of the valve spring. Likewise, a displacement of the valve spring for larger ball strokes is prevented, which otherwise could easily lead to faulty functioning of the support element and along with this to serious problems in the valve train of the internal combustion engine.

The described construction of the non-return valve 66 can be used in single-flow or double-flow hydraulic support elements. In addition, the construction of the non-return valve 66 can also be used in other hydraulic support elements, for example, those not used for lash compensation for a valve train of an internal combustion engine.

REFERENCE SYMBOLS

10 Hydraulic support element
12 Housing
14 Housing base
16 Outer lateral surface of the housing
18 Axial hole in the housing
20 Work part of the piston
22 Pressure part of the piston
24 Piston
26 Longitudinal center axis
28 Base of the piston
30 Walls of the piston
32 Outer lateral surface of the walls of the work part of the piston
34 Inner surface of the axial hole in the housing
36 End face of the wall of the work part of the piston
38 End face of the pressure part
40 Dome-shaped head
42 Hole in the head
44 Inner space in the work part
46 Inner space in the pressure part
48 Storage space, formed by inner spaces 44, 46
49 Annular gap
50 Radial hole in the housing
52 Opening in the pressure part of the piston
54 Housing edge
56 Retaining ring
58 Annular groove in the pressure part of the piston
60 High-pressure space
62 Annular groove in the base of the work part
64 Compression spring
66 Non-return valve
68 Ball
70 Ball guide
72 First ball seat on the storage space side
74 Second ball seat on the high-pressure space side
76 First projection on the second ball seat
78 Second projection on the second ball seat
80 Material thickness of the base of the work part of the piston
82 Diameter of the ball
84 Top side of the base of the work part
86 Bottom side of the base of the work part
90 Third projection on the second ball seat
92 Fourth projection on the second ball seat
100 Narrowing section on the first ball seat
102 Diameter of the ball guide
104 Arrow

106 Arrow
108 Ball stroke

The invention claimed is:

1. A hydraulic support element for insertion into a receptacle hole of a cylinder head of an internal combustion engine for lash compensation of a valve train of the internal combustion engine, the hydraulic support element comprising a hollow cylindrical housing including an outer lateral surface and a radially inner axial hole, a piston located in the radially inner axial hole, the piston is displaced coaxial to a longitudinal center axis in use, the piston includes an essentially hollow cylindrical pressure part and a pot-shaped work part connecting axially to said pressure part, at least one axial end-side head of the pressure part projects past a housing edge and is used as a support for a cam follower, an inner space of the pressure part and also an inner space of the work part form a storage space for a hydraulic medium, a high pressure space for the hydraulic medium defined by a base of the pot-shaped work part and the hole of the housing, a non-return valve hydraulically connects the storage space and the high pressure space, the non-return valve includes a ball for automatic lash compensation of the valve train, a compression spring is located between the base of the pot-shaped work part of the piston and a housing base to support the piston, and a retaining ring is arranged radially between the pressure part of the piston and the housing, said retaining ring limits an axial travel of the piston, an axially oriented ball guide is located on the base of the piston, the ball is displaceably held in the base of the work part in the axially oriented ball guide for displacement in the axial direction, the ball guide has a storage space side first ball seat and a high pressure space side second ball seat, and the two ball seats are formed with the base of the work part of the piston.

2. The support element according to claim 1, wherein the first ball seat closes completely hydraulically for said ball contacting the first ball seat.

3. The support element according to claim 2, wherein the second ball seat remains at least partially open for said ball contacting the second ball seat.

4. The support element according to claim 1, wherein the second ball seat has at least one radially inward directed projection or is formed by at least one projection.

5. The support element according to claim 1, wherein an axial material thickness of the base of the work part of the piston is equal to or greater than a diameter of the ball of the non-return valve.

6. A method for production of a hydraulic support element, comprising the following steps:

a) producing a pot-shaped work part of a piston of the hydraulic support element, which has, in a base thereof, an axially oriented ball guide that has a cylindrical section and an end-side narrowing section adjacent to said cylindrical section, wherein the narrowing section has a smaller diameter than a ball to be inserted into the ball guide and forms a storage space side first ball seat, b) inserting a ball into the ball guide of the work part of the piston, c) shaping the base of the work part of the piston on a high pressure space side bottom side thereof in the area of the ball guide for forming at least one radially inward pointing projection for forming a high pressure space side second ball seat, wherein the ball is held captively in the ball guide in interaction with the storage space side first ball seat and moves in an axial direction, and d) axially inserting the piston into a housing of the hydraulic support element.

7. The method according to claim 6, wherein the shaping in method step c) is performed by impact extrusion of the work part of the piston that is not hardened at least in some areas.

8. The method according to claim 6, wherein the shaping in the method step c) is realized by orbital forming or by radial spot forming of the work part of the piston that is hardened at least in some areas.

9. The method according to claim 6, wherein, before the method step a) or after the method step d), at least one of the ball, the work part, or a pressure part of the piston is subjected to a heat treatment for hardening at least in some areas.

10. The method according to claim 6, wherein, for installation of the support element in method step d), inserting at least one compression spring acting on the work part of the piston, inserting the shaped work part of the piston having the ball held therein, inserting a pressure part of the piston, and inserting a retaining ring into a hole of the housing of the hydraulic support element and securing the retaining ring in the housing in the axial direction.

* * * * *